United States Patent [19]

Watanabe et al.

[11] Patent Number: 5,002,516

[45] Date of Patent: Mar. 26, 1991

[54] COIN WRAPPING MACHINE

[75] Inventors: Kenkichi Watanabe, Kawasaki; Hideshi Sentoku; Takayoshi Asaoka, both of Tokyo, all of Japan

[73] Assignee: Laurel Bank Machines Co., Ltd., Tokyo, Japan

[21] Appl. No.: 400,946

[22] Filed: Aug. 31, 1989

[30] Foreign Application Priority Data

Aug. 31, 1988 [JP] Japan ..... 63-217196
Aug. 22, 1989 [JP] Japan ..... 1-215873

[51] Int. Cl.[5] ..... G07D 3/16; B65B 11/04

[52] U.S. Cl. ..... 453/7; 453/31; 453/32; 53/212; 53/532

[58] Field of Search ..... 453/5, 7, 11, 30, 31, 453/32, 56, 57; 53/532, 212

[56] References Cited

U.S. PATENT DOCUMENTS 4,123,892 11/1978 Asami ..... 453/31 X
4,353,195 10/1982 Nakamura ..... 53/212
4,370,990 2/1983 Watanabe ..... 453/32
4,861,312 8/1989 Sentoku ..... 453/7
4,896,481 1/1990 Sentoku et al. ..... 53/501
4,897,984 2/1990 Sentoku et al. ..... 53/501

FOREIGN PATENT DOCUMENTS 55-92990 7/1980 Japan .
59-84721 5/1984 Japan .
1531877 11/1978 United Kingdom .
1584094 2/1981 United Kingdom .

*Primary Examiner*—F. J. Bartuska
*Attorney, Agent, or Firm*—Fleit, Jacobson, Cohn, Price, Holman & Stern

[57] ABSTRACT

A coin wrapping machine which discriminates genuineness, denomination, etc. of coins, counts the monetary amount of the coins, sorts them out by denomination and wraps them in a desired order in separate denominations.

10 Claims, 4 Drawing Sheets

COIN WRAPPING MACHINE

CROSS REFERENCE OF RELATED APPLICATIONS

The present invention relates generally to the subject matter of the following prior U.S. patent applications: Ser. No. 07/170,379, filed on Mar. 18, 1988 now U.S. Pat. No. 4,861,312, entitled "Coin Handling Apparatus", Ser. No. 07/211,577 filed on June 27, 1988, now U.S. Pat. No. 4,897,984, entitled "Coin Receiving and Wrapping Apparatus" and Ser. No. 07/212,598, filed on June 28, 1988, now U.S. Pat. No. 4,896,481, entitled "Coin Receiving and Wrapping Machine".

BACKGROUND OF THE INVENTION

The present invention relates to a coin wrapping machine and more particularly, to a coin wrapping machine which can discriminate genuineness, denomination, etc. of coins, count the monetary amount of the coins, sort them out by denomination and wrap them in a desired order in separate denominations.

DESCRIPTION OF THE PRIOR ART

Financial institutes which handle a large amount of money in cash are required to count received coins and sort them out by denominations. There has been proposed for this purpose in Japanese Patent Application Laid-Open No. 55-92990 a coin counting/discriminating machine which can discriminate a group of coins of different and mixed denominations for their genuineness and by their denomination types, count the monetary amount thereof, remove counterfeit coins and sort them out by denominations.

There has been proposed a coin wrapping machine by Japanese Patent Application Laid-Open No. 59-84721 and others which wraps a predetermined number of coins of the same denomination as a group in order to facilitate handling of the received coins.

The prior art disclosed in Japanese Patent Application Laid-Open No. 59-84721 was detrimental in that coins cannot be wrapped in separate groups by an arbitrary denomination whenever necessary because the machine was adapted to wrap coins in the order of coin diameters from the largest. More particularly, the prior art coin wrapping machine is structured to have a coin sorting passage defined with a fixed guide rail and a movable guide rail which are adjusted to have a space therebetween so that coins of the desired denomination to be wrapped are led to pass through while coins of other denominations are forced to drop between the above two guide rails to be collected. Due to this construction, coins can be wrapped only in the order of diameter size or from the largest diameter thereof.

The problem may be solved by using the coin counting/discriminating machine disclosed in the JPA Laid-Open No. 55-92990 and the coin wrapping machine disclosed in the JPA Laid-Open No. 59-84721 in combination so that coins are first sorted out by denominations by the coin counting/discriminating machine, and then deposited in the coin wrapping machine sequentially in the order of denominations to be wrapped. However, when received coins are discriminated first by the coin counting/discriminating machine according to the denominations and then only the coins of the denomination to be wrapped are deposited into a coin wrapping machine, the two machines occupy a large space. Further, an additional operation to transfer the coins which have been sorted by the first machine to the second machine is required, not only adding extra work but causing possible misplacing of coins during the transfer operation.

SUMMARY OF THE INVENTION

An object of the present invention is therefore to provide a coin wrapping machine which can count and sort out coins by denominations as well as select coins of any arbitrary denominations and wrap them by means of a single piece of equipment.

The above object of the present invention is achieved by a coin wrapping machine comprising an upper hopper means through which coins can be deposited, a first coin sorting passage which transports coins deposited through said upper hopper means, a sensor means which is provided at said first coin sorting passage to detect genuineness and denomination of a coin and to count the coins according to different denominations, a coin rejecting gate means which removes counterfeit coins or uncurrent coins from said first coin sorting passage, and provided with a large diameter coin collecting means for collecting coins of diameters larger than that of a denomination to be wrapped, a second coin sorting passage which is connected at the downstream end of said guide means and transports coins in a direction different from said first coin sorting passage and which is provided with a small diameter coin collecting means for collecting coins of diameters smaller than that of the denomination to be wrapped, a counter means which is provided on said second coin sorting passage downstream to said small diameter coin collecting means and which counts the number of coins being carried by the second coin sorting passage, a coin stacking means which is provided downstream to said second coin sorting passage and which is provided with a pair of stack drum means to stack the coins which have been fed from said second coin sorting passage, a coin wrapping means which receives stacked coins from said coin stacking means and wraps them in a roll of coins of predetermined number, a wrapped coin storing means which stores rolls of coins that have been wrapped by said coin wrapping means, a collecting box means which communicates with said large diameter coin collecting means and smaller diameter coin collecting means and which is formed on the bottom thereof with open/close gate means, a lower hopper means which is provided below said collecting box means and said coin wrapping means, which communicates with said collecting box means when said open/close gate means is opened and which is communicating with said coin wrapping means, a conveyor means which is provided below said coin wrapping means and which can transport the coins in said lower hopper means to said upper hopper means, a collecting means for fractional coins which collects coins of the number less than said predetermined number, a first gate means which is provided between said coin wrapping means and said fractional coin collecting means and of which position is switchable, a second gate means which is provided between said first gate means and said fractional coin collecting means and of which position is switchable, a coin feed detecting means which detects supply of coins to said coin stacking means, a rotation detecting means which detects rotation of said pair of stacking drum means, and a control means which receives detection signals and count signals from said sensor means, count signals from said counting means, coin feed signals from said coin feed detecting means and rotation detecting signals from said rotation detecting means to count the monetary amount of received coins according to the denominations and/or the number of received coins, maintains said first gate means at a position which does not allow communication between said coin wrapping means and said second gate means for a predetermined time period after said coin wrapping means received stacked coins from said coin stacking means, and suspends actuation of said coin wrapping means but maintains said first gate means at a position which does not allow communication between said coin wrapping means and said second gate means when, based on these input signals, it judges that coins are jammed in said first coin sorting passage and/or the second coin sorting passage, as the number of coins of a denomination detected by said sensor means exceeds the number of coins of said denomination detected by said counter means, or when it judges that rotations of said pair of stacking drum means corresponding to the number of coins of the denomination which have been fed to said coin stacking means and detected by said coin feed detecting means exceeds a predetermined value.

The above and other objects and features of the present invention will become apparent from the following description made with reference to accompanying drawings.

DESCRIPTION OF THE PREFERRED EMBODIMENTS

Figure 1:
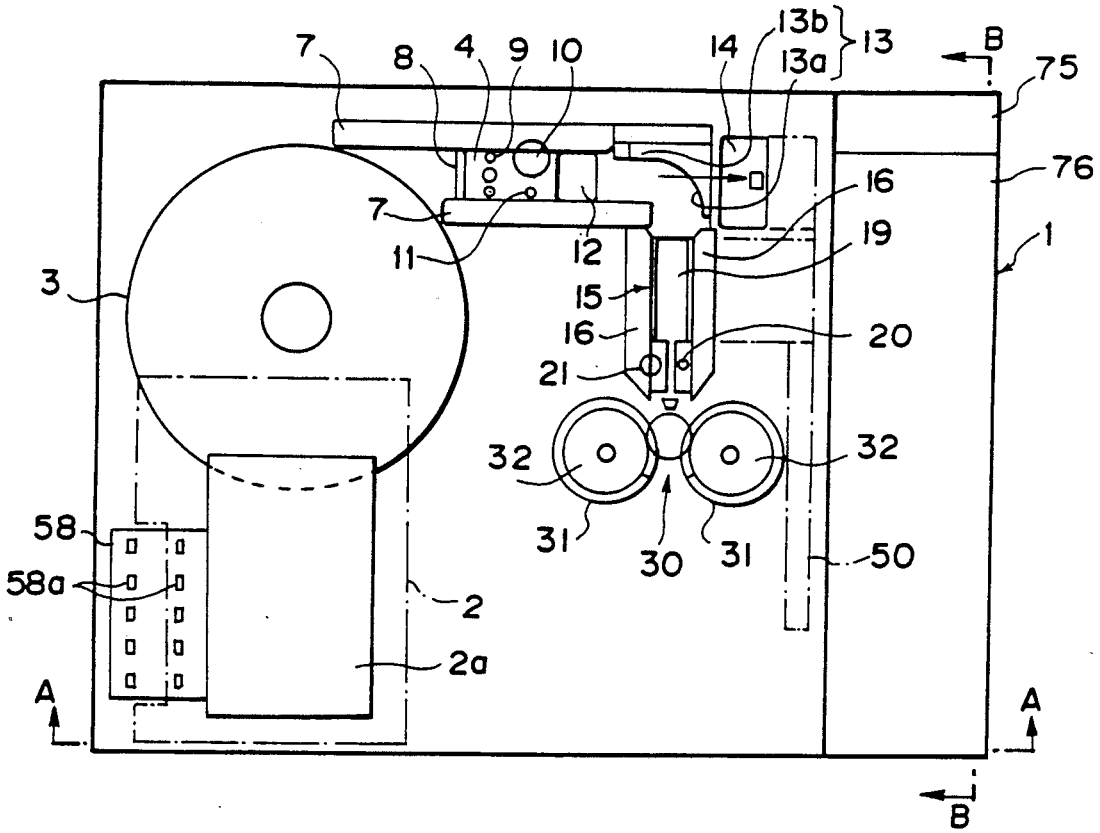
FIG. 1 is a schematic plan view of an embodiment of the coin wrapping machine according to this invention to show the coin counting sorting mechanism.
Figure 2:
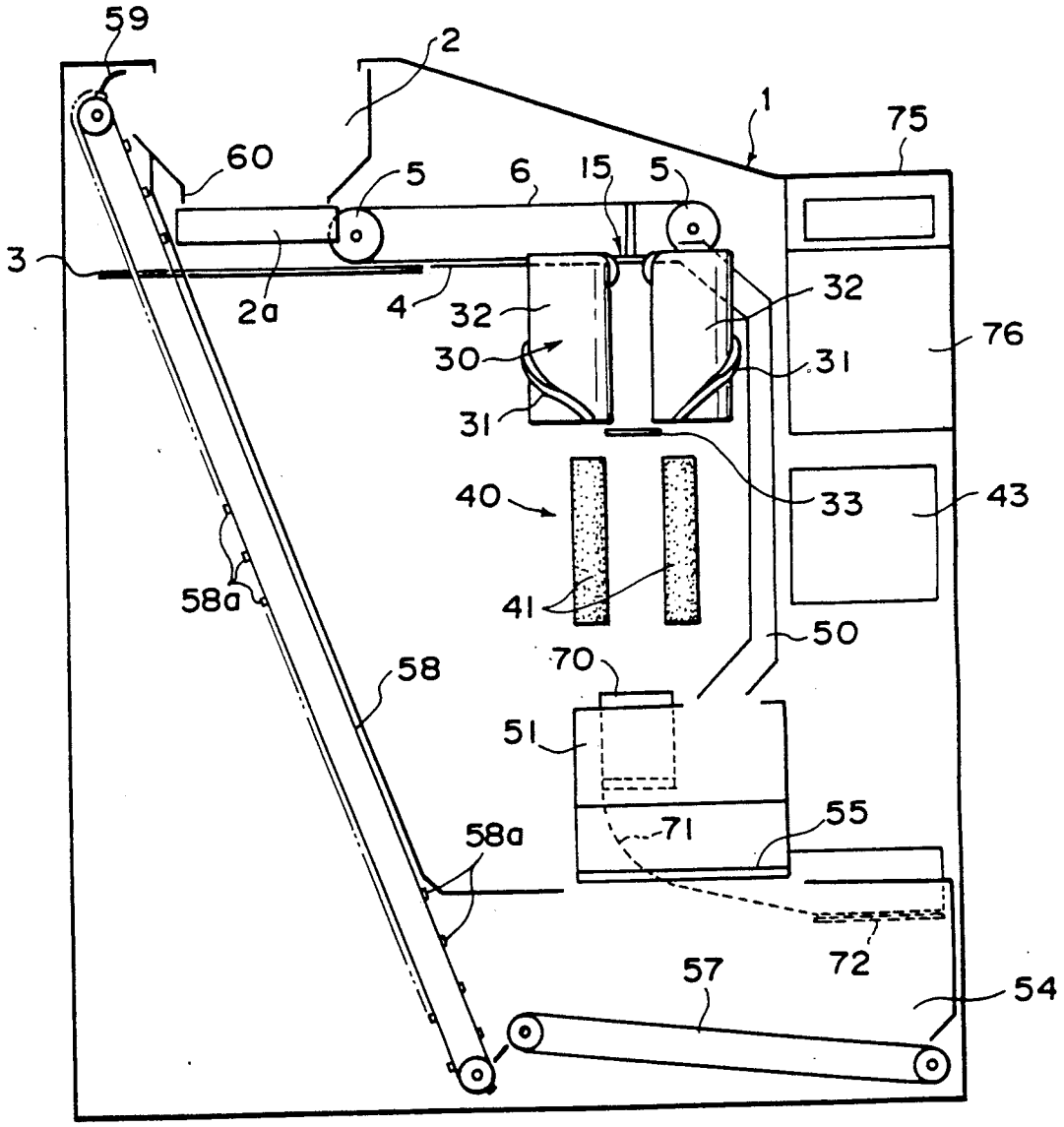
FIG. 2 is a cross sectional view of FIG. 1 along the line A—A.
Figure 3:
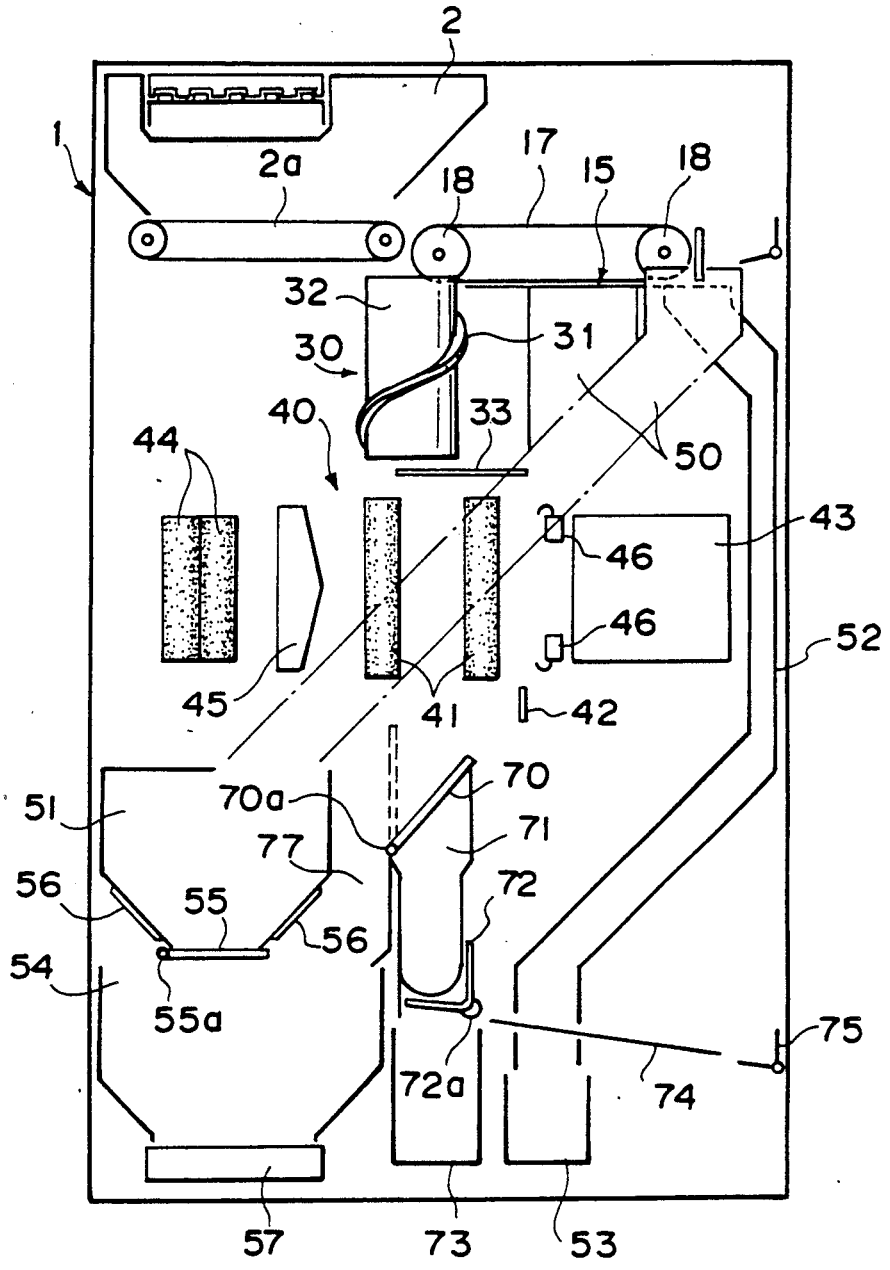
FIG. 3 is a cross sectional view of FIG. 1 along the line B—B.

Referring to the FIGS. 1 through 3, an embodiment of the coin wrapping machine according to this invention includes a casing 1 which houses internal mechanisms, an upper hopper 2 through which coins are deposited, a feed belt 2*a* which defines the bottom of said upper hopper 2 and feeds the coins deposited in the upper hopper 2 into a rotating disc 3 and the disc 3 which receives the coins from the upper hopper 2. The disc 3 is provided with a vertical rotational shaft and is made rotatable by a first driving means (not shown) within a horizontal plane. The disc 3 is provided on the periphery thereof with an annular guide (not shown) so that coins are fed into the disc 3 to be moved along the annular guide by the centrifugal force produced by the rotation of the disc 3, and discharged one by one into a first coin sorting passage 4 through an outlet (not shown) on the annular guide.

In the first coin sorting passage 4, an endless conveyor belt 6 which is wound around pullies 5 is provided at a predetermined space from the upper surface of the passage. Coins sent from the disc 3 into the first coin sorting passage 4 are conveyed through the first passage 4 by the conveyor belt 6 which is driven by the first driving means while being held between the upper surface of the passage and the belt 6.

A pair of parallel guide rails 7 is provided on both sides of the first coin sorting passage 4 at an interval which is set to be larger than diameters of all the coins which are to be processed.

The first passage 4 is provided with a first sensor 8 which detects the diameter of the coins, and a second sensor which detects magnetic property of the coins. Detection signals from the first and second sensors 8, 9 are inputted at a control system (not shown) for counting the monetary amount of received coins according to the denominations as well as judging the genuineness and the denomination of the coins.

Figure 4:
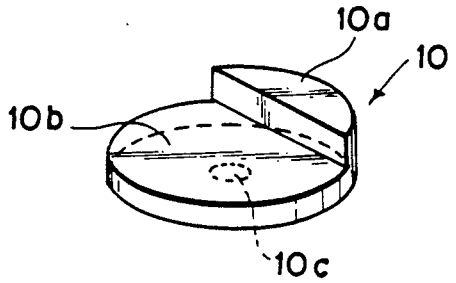
FIG. 4 is a schematic perspective view to show the shape of a stopper.

A stopper 10 is provided downstream of the second sensor 9 which prevents further feed through the first coin sorting passage 4 of counterfeit or uncurrent coins when the control system detects such counterfeit or uncurrent coins based on the detection signals from the first and second sensors 8 and 9. As shown in FIG. 4, the stopper 10 is formed by cutting out a cylinder along a plane parallel to the axis thereof in a manner to leave the bottom thereof, and includes a projection 10*a* and a bottom 10*b*. The stopper 10 is placed in such a manner that the upper surface of the bottom 10*b* comes on the same plane as the upper surface of the first coin sorting passage 4 and that only the bottom 10*a* is normally located within the passage 4 while the projection on the side of the bottom 10*b* comes at the same level with the inner surface of the outer guide rail 7. When the control system detects a counterfeit or uncurrent coin, the control system actuates the first driving means (not shown) to rotate a rotating shaft 10*c* of the stopper 10 so that the projection 10*a* comes to a position inside the first passage 4 for stopping the feed of the counterfeit or uncurrent coin.

The first coin sorting passage 4 is further provided with a coin rejecting gate 12 downstream of the stopper 10 which eliminates counterfeit or uncurrent coins from the first passage 4 and collects them. The gate 12 is normally closed, and the upper surface thereof is placed at the same level as the upper surface of the first passage 4 to secure smooth passage of coins.

When the control system detects a counterfeit or uncurrent coin based on the detection signals from the first and second sensors 8, 9, the control system actuates the first driving means to rotate the stopper 10 for suspending the feed of the counterfeit or uncurrent coin, suspends the rotation of the disc 3, and the traveling of the conveyor belt 6, outputs timing signals after a predetermined time lapse for driving the first driving means to rotate the stopper 10 in the reverse direction to assume its original position, opens the gate 12, and resumes the rotation of the disc 3 and traveling of the conveyor belt 6. As a result, a counterfeit or uncurrent coin is rejected outside the first passage 4 through the gate 12.

At a position symmetrical to the stopper 10 in respect of the coin conveying direction of the first passage 4 is provided a third sensor 11 which outputs ON signals to the control system when a coin passes above the upper surface thereof. Third sensor turns ON when the stopper 10 is rotated to suspend the movement of a counterfeit or uncurrent coin, and turns OFF the counterfeit or uncurrent coin goes off the third sensor 11 upon resumption of the disc 3 rotation and the traveling of the conveyor belt 6 as the stopper 10 is rotated in the reverse direction. Then, the control system actuates the first driving means based on the input signals from the third sensor 11 to rotate the stopper 10 so as to prevent elimination of genuine coins coming after the counterfeit or uncurrent coin.

When a predetermined time lapses after the gate 12 is opened, the control system outputs timing signals to the first driving means to close the gate 12 as well as to rotate the stopper 10 in the reverse direction to restore the original position and resume the conveying of the coins.

At the terminal of the outer guide rail 7 is provided a guide member 13 having a guide surface 13*a* formed as an arc for guiding the periphery of a coin and for changing the conveying direction of the coins by about 90 degrees. The guide member 13 is structured to be movable in the direction perpendicular to the direction of conveying coins in the first passage 4 so that the space between the inner guide rail 7 and the guide surface 13*a* may be adjusted. The upper surface of the guide member 13 has a sloped surface 13*b* which is gradually raised toward the coin conveying direction. Therefore, by setting the interval between the guide surface 13*a* and the inner guide rail 7 to be equal to the diameter of the coin of the denomination to be wrapped, coins of the diameter larger than said diameter are not guided by the guide surface 13*a*, but ride over the sloped surface 13*b*, and without changing advancing direction, are collected through a larger diameter coin collecting port 14 provided downstream of the guide member 13 in respect of the direction of conveying coins in the first passage 4.

A second coin sorting passage 15 is connected downstream to the first passage 4 via the guide member 13, and coins having the diameters equal to or smaller than the diameter of the coins of the denomination to be wrapped are guided by the lead surface 13*a* of the guide member 13 and fed into the second coin sorting passage 15 from the first passage 4.

The second passage 15 is provided with a pair of guide rails 16 which are parallel to each other and adjustable of the interval therebetween. A conveyor belt 17 is suspended around pullies 18 between the pair of guide rails 16 and is driven by the first driving means to convey the coins, holding the coins tightly with the passage. A smaller diameter coin collecting port 19 is formed on the bottom of the second coin sorting passage 15 between the pair of guide rails 16.

The interval between the pair of guide rails 16 is adjusted to be larger than the diameter of coins which is smaller than that of the coins of the denomination to be wrapped, and therefore all the coins having smaller diameters than that of the coins of the denomination to be wrapped are collected through the port 19.

At the downstream of the second coin sorting passage 15 is provided a wrapped coin stacker 30 which stacks coins to be wrapped.

Downstream of the second passage 15 is provided a counter 20 which counts the number of coins that are passing thereabove. The counter counts the number of coins that are sent to the stacker 30 and outputs counting signals to the control system. A stopper 21 of the structure similar to the stopper 10 is provided opposite the counter 20 on the second passage 15. When the control system judges that a predetermined number of coins for one roll, for example 50 pieces, have been fed into the stacker 30 based on the counting signals inputted from the counter 20, it actuates the first driving means to rotate the stopper 21 in order to prevent subsequent supply of coins to the stacker 30 and suspend the rotation of the disc 3 and the traveling of the conveyor belt 17.

The stacker 30 includes a pair of rotatable stack drums 32, 32 with spiral projections 31 formed on the outer periphery thereof. The interval between the pair of drums 32, 32 is adjustable, and is adjusted beforehand to accommodate the coin diameter to be wrapped. Everytime the counter 20 detects a coin, the control system outputs a predetermined number of pulses to a stack drum rotating means (not shown) so that the pair of drums are controlled to rotate for a predetermined number of times per pulse. Although not shown in the figure, a guide plate is provided above the upper surface of the drums 32, 32 at an interval larger than the maximum thickness of the coins to be wrapped for preventing the coins from jumping out. There is also provided a limit sensor which detects whether a coin is in contact with the guide plate.

The coins which have been fed into the stacker 30 are held on their peripheries with the spiral projections 31 and directed to move downward gradually by the rotation of the pair of the drums 32, 32. The pair of drums 32, 32 are kept rotating even after the control system judges that a predetermined number of coins for one roll, for example 50 coins, have been fed to the stacker 30 based on the counting signals from the counter 20 and suspends the feeding of the coins thereto by the stopper 21. The drums finally stop rotating when the predetermined number of coins have been stacked at a shutter 33 which is provided below the drums 32, 32. This embodiment is so constructed that a predetermined number of coins are stacked on the upper surface of the shutter 33 when the drums 32, 32 are rotated once.

Beneath the shutter 33 is provided a coin wrapping section 40 which comprises, a well known, three wrapping rollers 41, 41, 41, a supporting member 42 which supports with its upper surface the coins that have been stacked by the stacker 30, a feeding roller 44 which feeds wrapping paper from a roll 43 to the rollers 41, 41, 41, a cutter 45 which cuts the paper when a predetermined length of the paper is supplied to the rollers 41, 41, 41, and crimping claws 46, 46, which crimp the paper at the top and the bottom thereof after the paper is wrapped around the stacked coins. For facilitating the description, the supporting member 42 is not shown in FIG. 2.

When not in wrapping operation, the supporting member 42 is retracted sideways below the three rollers 41, 41, 41 as shown in FIG. 3, and starts moving only when the counter 20 detects the predetermined number of coins. The member 42 then moves upward through the three rollers 41, 41, 41, and comes to a position immediately below the shutter 33 by the time the drums 32, 32 have rotated once. Upon detecting this state, the control system opens the shutter 33 and transfers the stacked coins from the upper surface thereof to the surface of the supporting member 42. After receiving the stacked coins, the member 42 starts to move downward, and the three rollers 41, 41, 41 rotate and move to approach each other in synchronization with the movement of the member 42. At the same time, the roller 44 pulls out the wrapping paper from the roller 43 and feeds it between the rollers 41, 41, 41 and the stacked coins. The stacked coins are therefore held tightly by the rollers 41, 41, 41 via the paper. At this time point, the control system closes the shutter 33 and rotates the stopper 21 reversely, and at the same time, resumes driving of the disc 3 and the conveyor belts 6, 17.

When a predetermined length of paper is placed around the stacked coins, the rotation of the roller 44 is suspended, and the paper is pressed hard on the cutter with the tension produced by the rotation of the rollers 41, 41, 41 to be cut. Then, the paper is crimped with the claws 46, 46, at the top and the bottom thereof to complete wrapping of the coins.

As shown in FIGS. 2 and 3, the coins of diameters larger than that of the coins to be wrapped which are collected via the port 14 and those of smaller diameter than that of the coins to be wrapped which are collected via the port 19 are sorted in a box 51 via a chute 50. The counterfeit and uncurrent coins that are rejected from the first passage 4 via the gate 12 are collected in a reject box 53 via a reject chute 52.

A lower hopper 54 is provided under the box 51. The lower hopper 54 is adapted to receive the coins collected in the box 51 as a gate 55 constituting the bottom of the box 51 is rotated around a horizontal shaft 55*a* to open. The lower hopper 54 is provided with an opening (not shown) which communicates with a door (not shown) on the casing 1. Coins may be thrown in the lower hopper 54 via the opening (not shown) by opening the door on the casing 1.

The box 51 is supported movable by sliding rails 56 in the lateral direction as in FIG. 2 and is structured to allow recovery of the coins housed in the box 51 by opening the door (not shown) on the casing 1 and taking out the box.

The lower hopper 54 comprises on the bottom thereof a first endless conveyor belt 57 which is slanted gradually upward toward the left in FIG. 2. A second conveyor belt 58 is suspended between the lower and upper hoppers 54, 2 in a manner that coins may be transferred from the first belt 57 to the second belt 58. As shown in FIGS. 1 and 2, the second belt 58 is provided with plural serated projections 58*a*.

The first conveyor belt 57 may be driven intermittently. By operating the belt 57 intermittently, the coins housed in the lower hopper 54 and held on the first belt 57 are sent to the second belt 58 one by one. The coins are engaged with the serated projections 58*a* of the second belt 58 at their lower periphery and held with their face on the surface of the belt 58 to be carried upward from the lower hopper 54 to the upper hopper 2. A scraper plate 59 is attached on the casing 1 near the upper end of the second belt 58 at a position which allows the scraper to be engaged with the serated projections 58*a* of the second belt 58 and yet abutted to the upper periphery of a coin while the coin is being carried so that it can scrape off the coin from the belt 58 downward toward the upper surface of the belt 2*a* via the chute 60 and to the disc 3.

A first gate 70 is provided below the rollers 41, 41, 41 in a manner to rotate around a horizontal shaft 70*a*. The gate 70 can be disposed at the first position which allows communication between a chute 71 and the coin wrapping section 40 below as shown by the broken line in FIG. 3 and at a second position which intercepts the communication as shown by solid line in FIG. 3.

A second gate 72 in the form of a letter L is provided at the lower end of the chute 71. The second gate 72 is structured to rotate around a horizontal shaft 72*a* and to receive the coins which have been fed to the chute 1 when the first gate 70 is shifted to the first position.

A fractional coin collecting box 73 is provided below the second gate 72 for collecting fractional coins of the denomination to be wrapped. In FIG. 3, a guide plate 74 is provided on the right of the second gate 72, and is inclined toward the right. A coin lift 75 is provided at the terminal of the guide plate 74 in a manner to move up and down.

The second gate 72 rotates from the position shown in FIG. 3 by ca. 90 degrees clockwise if the coins received from the wrapping section 40 via the first gate 70 and chute 71 are wrapped coins in a stack and feeds the stack into the guide plate 74. On the other hand, the gate 72 rotates from the position in FIG. 3 by ca. 90 degrees counterclockwise if the received coins are fractional in number with respect to coins of the denomination to be wrapped in a roll and drops the fractional coins into fractional coin collecting box 73. The wrapped coins fed onto the guide plate 74 are transferred to the lift 75 and housed in a wrapped coin storing box 76 as the lift is elevated upward.

A chute 77 is provided between the coin wrapping section 40 and the lower hopper 54 to communicate them.

The rotation of the first and second gates 70, 72 and the vertical movement of the lift 75 are controlled by the control system so that the first and second gates 70 and 72 are normally positioned at the positions shown with the solid lines in FIG. 3.

Although not shown in FIGS. 1 through 3, a rotary encoder is provided to detect the number of rotations of the drums 40, 40 and a microphone is provided near the first gate 70 to detect whether a coin abuts against the gate.

Figure 5:
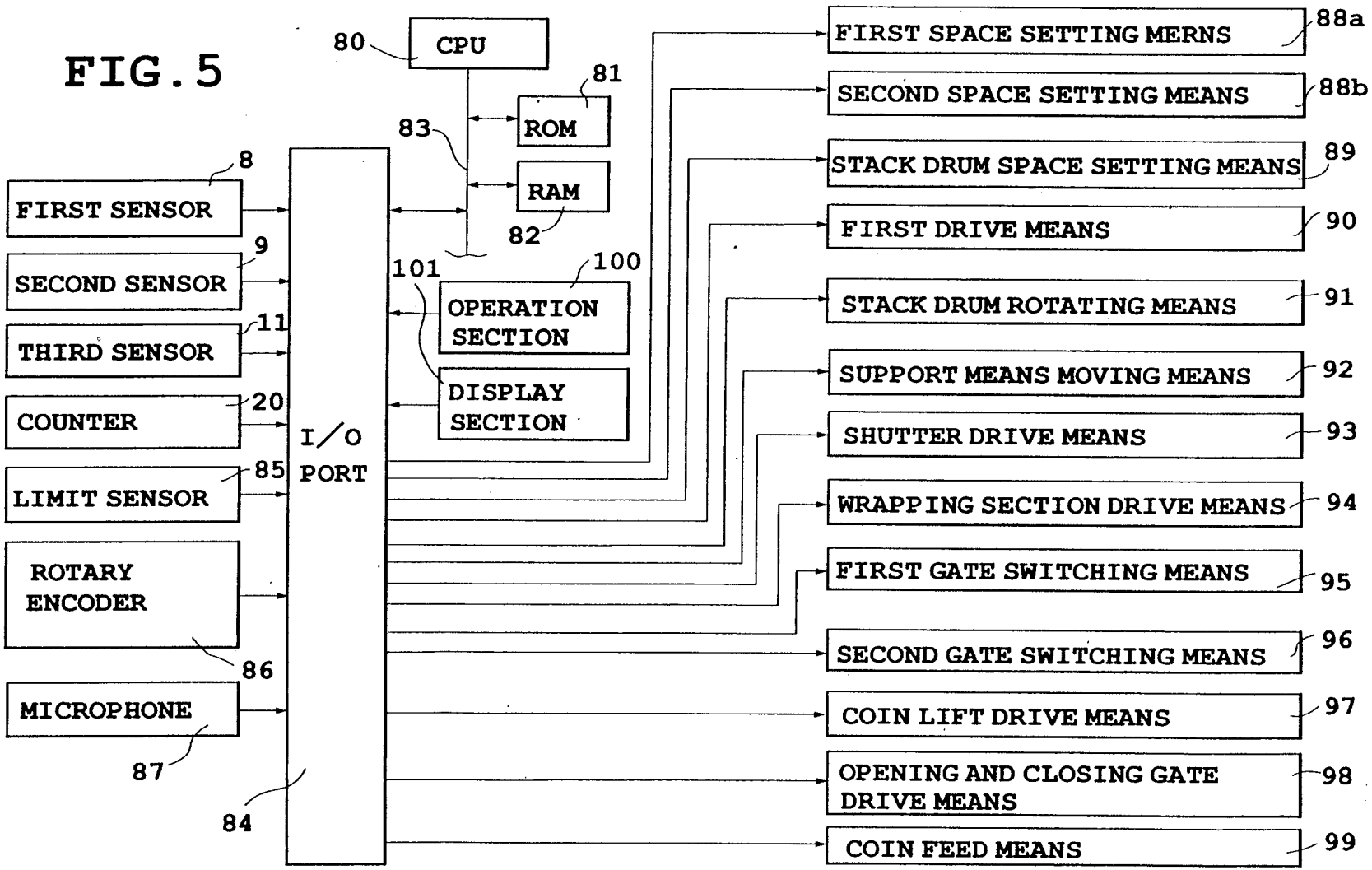
FIG. 5 is a block diagram of the control, detection and driving systems of the coin wrapping machine which embodies the present invention.

FIG. 5 is a block diagram to show the control, detection and driving systems of the embodiment of the coin wrapping machine according to this invention.

In FIG. 5 the control system of the embodiment of this invention coins wrapping machine includes a CPU 80, a ROM 81 storing various control programs, a RAM 82 which temporarily stores instruction signals from an operator and detection signals from various detecting means, a bus 83 and an I/O port 84 which inputs/outputs various signals.

The detection system of the embodiment includes a first sensor 8 which outputs to the control system detection signals of genuineness and denomination of coins sent from the disc 3 to the first passage 4 and outputs counting signals of the monetary amounts of received coins in separate denomination groups, a second sensor 9, a third sensor 11 which outputs coin detection signals to the control system for controlling the rotation timing of the stopper 10, a counter 20 which counts the number of coins that are sent to the stacker 30 and outputs counting signals to the control system, a limit sensor 85 which detects whether or not a coin abuts against the guide plate provided above the pair of drums 32, 32 and outputs detection signals to the control system, a rotary encoder 86 which detects the number of rotations of the drums 32, 32 and outputs the rotation signals to the control system, and a microphone 87 provided near the first gate 70 which detects vibration produced by the collision of the coin against the first gate 70 and outputs the signal to the control system.

The driving system of the embodiment of this inventive coin wrapping machine includes a first space setting means 88a which moves the guide member 13 so as to set the space between the guide surface 13*a* thereof and the inner guide rail 7 at a desired value, a second space setting means 88*b* which moves the pair of guide rails 16, 16 so as to set the space between the pair of guide rails 16, 16 at a desired value, a stack drum space setting means 89 which moves the pair of drum 32, 32 to set the space therebetween at a desired value, a first driving means 90 which rotates the disc 3, runs the belts 6 and 17 as well as rotates the stoppers 10 and 21 and opens/closes the coin rejecting gate 12, a stack drum rotating means 91 which rotates the pair of drums 32, 32, a support means moving means 92 which moves the supporting means 42, a shutter drive means 93 which opens/closes the shutter 33, a wrapping section drive means 94 which rotates the rollers 41, 41, 41 and the feed roller 44 and actuates crimping claws 46, 46, a first gate switching means 95 which switches the first gate 70 between the first and second positions, a second gate switching means 96 which rotates the second gate 72 either clockwise or counterclockwise by ca. 90 degrees, a coin lift drive means 97 which moves the coin lift 75 up and down, an opening and closing gate drive means 98 which opens/closes the gate 55 of the collecting box 51 and a coil feed means 99 which runs the second conveyor belt 58 and the feed belt 2*a*.

The coin wrapping machine according to this invention is equipped with plural keys which can be manipulated by an operator, an operation section 100 in the control system which outputs desired instruction signals based on the key manipulations of the operator, and a display 101 which can display necessary information.

The embodiment of this inventive coin wrapping machine which is structured as above allows an operator to select an arbitrary mode from plural modes by simply pressing the keys from the section 100. The modes include a wrapping/counting mode in which an arbitrary denomination is selected and the coins are wrapped in different denominations starting from the selected one or in the selected denomination alone while counting the monetary amounts of the coins by the denominations and the total monetary amount of the coins, a wrapping mode in which an arbitrary denomination is selected and the coins are wrapped in different denominations or starting from the selected one or in the selected denomination alone without counting the received coins, and a counting mode which counts the monetary amount of received coins by the denominations or the total thereof without wrapping them. The embodiment of the coin wrapping machine according to this invention is further characterized in that when jamming occurs either in the first or the second passage 4 or 15 so that not all the coins fed from the disc 3 are fed to the stacker 30 but remain in the passage even if the belts 6 and 17 are moved in the reverse direction briefly and then in the normal direction (referred to as jamming inside the passage herein), when at least a part of the stacked coins is not properly supported by the spiral projections 31, such as that some of the coins are standing on the stacker 30 as detected by the fact that the difference between the number of pulses necessary to stack a predetermined number of coins on the stacker 30 and the number of pulses actually outputted to the stack drum rotating means 91 from the control system exceeds a predetermined value (referred to as irregular stack), or when at least a part of stacked coins is not properly received by the supporting member 42 but dropped in the course of transportation from the shutter 33 to the member 42 (referred to as irregular transfer), coins sent to the stacker 30 may be recovered in the lower hopper 54 and sent to the stacker once again via the upper hopper 2, the first passage 4 and the second passage 15 to be wrapped.

In the embodiment of this coin wrapping machine according to this invention, when an operator selects the wrapping/counting mode by manipulating mode keys at the section 100, he can conduct wrapping operation of the coins in the following manners:

(1) to designate a predetermined denomination and wrap the coins of the denomination alone, and to conduct counting and sorting of the coins of other denominations.

(2) to first designate coins of a denomination and wrap the same, and to conduct counting/sorting operations of the coins of other denominations, then wrap them in any of the orders of the diameter of the coins from the largest or the smallest, of the volume of currency or of the number.

(3) to wrap the coins in the order of the diameter either from the largest or the smallest, or of the volume of currency.

(4) to count the number of coins of all the denominations and then wrap them in the order of the number of the coins.

Moreover, by manipulating a key at the section 100, the number of coins to be wrapped in a roll may be arbitrarily set in the wrapping machine according to this invention.

The ROM 18 stores the order of coin diameters either from the largest and the smallest, the order of the denominations by the volume of currency, and standard number N of coins to be wrapped in addition to the control program to enable wrapping operation of the coins in the above manners. It also stores data on the diameters and materials of the coins to be processed to judge the denominations and genuineness, data on the thickness of coins to control the rotation of the stack drums 32, 32 for one coin when the coins are being stacked on the stacker 30.

The RAM 82 is equipped with a memory which stores the monetary amount by the denominations, the number of coins by the denominations and the total monetary amount of the received coins, the monetary amount, the number of the wrapped coins and the number of rolls by the denominations stored in the box 76, the monetary amount and the number of the coins by the denominations housed in the box 51, the amount and the number of the coins by the denominations housed in the box 51, the amount and the number of the coins by the denominations collected in the box 73, the denomination of the coins designated to be wrapped, the order of wrapping of the designated coins, and number of coins to be wrapped in a designated roll.

The operation of the coin wrapping machine with the above structure is started by selecting and manipulating at the section 100 a key to designate a mode, and then a key to designate the denomination of the coins to be wrapped or the order of denominations of the coins to be wrapped when the coins to be wrapped are deposited into either the upper hopper 2 or the lower hopper 54.

When the wrapping/counting mode is designated with a mode key, the first space setting means 88*a* is actuated, and the space between the inner guide rail 7 and the guide surface 13*a* of the guide member 13 is set to be larger than the diameter of the coins of the denomination which is designated by the operator to be wrapped first (referred to as the designated coin herein) but smaller than the smallest of other larger coins; the second space setting means 88*b* is actuated, and the space between the pair of guide rails 16 is set so that the opening of the small diameter coin collecting port 19 formed therebetween becomes smaller than the diameter of the designated coin but larger than the largest of all the other coins smaller than the designated coin; and the stack drum space setting means 89 sets the space between the pair of the stack drums 32, 32 to support the designated coin by its periphery with the spiral projections 31, 31.

At the same time, the CPU 80 actuates the coin feeding means 99 to run the first and second conveyor belts 57 and 58 as well as to rotate the disc 3. As a result, when a coin is deposited in the upper hopper 2, the coin is sent from the upper hopper 2 to the disc 3 by the belt 2*a* while a coin deposited in the lower hopper 54 is sent to the upper hopper 2 by the first and second conveyor belts 57, and 58, and then from the upper hopper 2 to the disc 3 by the belt 2*a*.

Coins thus sent to the disc 3 are sent to the first sorting passage 4 one by one along the annular guide (not shown) with the centrifugal force produced by the rotation of the disc 3, and are detected of the genuineness and denomination thereof by the first and second sensors 8 and 9, and counted of their monetary amount and number in separate denomination groups.

The signals for the genuineness of the coins detected by the first and second sensors 8, 9 are inputted at the I/O port 84 and inputted at the CPU 80 via the bus 83. The counting signals of the coins by denominations detected by the first and second sensors 8 and 9 are inputted at the I/O port 84 and stored in a predetermined memory of the RAM 82 via the bus 83 and displayed at the display 101. The CPU 80 outputs the signal for suspending transportation of the coins to the first drive means 90 when it judges a counterfeit or uncurrent coin has been sent into the first passage 4 based on the detection signals, to thereby rotate the stopper 10 and suspend the traveling of the belt 6 and the rotation of the disc 3, preventing further traveling of the particular coin. After the lapse of a predetermined time, the CPU 80 outputs timing signals to the first drive means 90, rotates the stopper 10 reversely to assume the original position, resumes the movement of the disc 3 and of the belt 6 and opens the rejecting gate 12. As a result, a counterfeit or uncurrent coin is rejected through the gate 12 and sent to be collected in the box 53 via the reject chute 52.

The CPU 80 receives the detection signals inputted from the third sensor 11 via the I/O port 84 and the bus 83. After the traveling of the counterfeit or uncurrent coin is prevented by suspending the rotation of the stopper 10 and the running of the disc 3 and the belt 6, the stopper 10 is rotated reversely and the running of the disc 3 and the belt 6 is resumed, when the third sensor 11 no longer detects the coin and an OFF signal is inputted at the CPU 80. Then, the CPU 80 outputs a signal for rotating the stopper to the first driving means 90 to resume rotation of the stopper 10 to suspend the traveling of the subsequent coins, preventing the same from being rejected through the gate 12.

When a predetermined time has lapsed after the opening of the gate 12, the CPU 80 outputs timing signals to the first drive means 90 to close the gate 12 and rotate the stopper 10 reversely to assume the original position and thereby resumes the transportation of the coins.

The coins which have passed through the first, second and third sensors 8, 9 and 11 are advanced further through the first passage 4. Coins having diameters equal to and smaller than the designated coin are sent to the second passage 15 along the guide surface 13*a* of the guide member 13, but those of the diameter larger than the designated coin ride over the guide surface 13*b* of the guide member 13 as the space between the inner guide rail 7 and the guide member 13 has been set as mentioned above, and continue their travel in the direction of extension of the first passage 4 to be collected in the box 51 via the chute 50. The amount and number of coins by denominations collected by the box 51 through the port 14 can be calculated from signals detected by the first and second sensors, which are stored in a predetermined memory in the RAM 82, and displayed at the display 101.

Coins having diameters smaller than the designated coin that are sent to the second passage 15 drop into the chute 50 from the port 19 to be collected in the box 51 as the space between the pair of guide rails is set as mentioned above. The amount and the number of the coins by denominations to be collected in the box 51 can be calculated from signals detected by the first and second sensors 8, 9, which are stored in a predetermined memory in the RAM 82 and displayed at the display 101.

Accordingly, the designated coins alone are advanced further in the second passage 15 and the coins that are sent to the stacker 30 are counted by the counter 20 provided on the second passage 15.

The counting signals from the counter 20 are inputted at the I/O port 84 and then at the CPU 80 via the bus 83. As described above, the ROM 81 stores the number $\underline{N}$ of the coins to be wrapped. The operator can designate the number $\underline{n}$ of the coins to be wrapped in one roll by manipulating a predetermined key at the section 100. When the number of coins to be wrapped is designated by the operator, the designated number $\underline{n}$ is inputted at the RAM 82 and stored in a predetermined memory to supercede the standard number $\underline{N}$ stored in the ROM 81 so that the designated number of coins may be wrapped in a roll. Alternatively, when the operator does not give any instruction, the number $\underline{N}$ stored in the ROM 81 is set as the number of coins to be wrapped in one roll.

When the CPU 80 judges from the counting signals inputted from the counter 20 that the number of coins that have passed through the counter and sent to the stacker 30 equals with the number $\underline{N}$ or $\underline{n}$ stored in either ROM 81 or RAM 82 as the number of coins to be wrapped in one roll, it outputs a completion signal to the first drive means 90 to rotate the stopper 21 and suspend the rotation of the disc 3 and the running of the belts 6 nd 17 to thereby suspend transportation of the coins.

When the CPU 80 has received detection signals via the I/O port 84 and the bus 83 inputted from the limit sensor 85 which detects whether a coin contacts with the guide plate (not shown) provided above the pair of drums 32, 32, and judges that the coin is in contact with the guide plate, the CPU 80 reads the thickness of the designated coin from the ROM 81, outputs pulses of a predetermined number corresponding to the thickness to the means 91, rotates the pair of drums 32, 32 for the number of times corresponding to the pulses, and sends the coins downward one by one while holding the respective coins with the spiral projections 31 formed on the outer periphery of the drums 32, 32. This operation is repeated every time the limit sensor 85 detects a coin until coins in the number $\underline{N}$ or $\underline{n}$ are fed between the pair of drums 32, 32. By one rotation of the drums 32, 32, coins in the predetermined number N or n are placed in a stack on the surface of the shutter 33.

When the CPU 80 judges based on the counting signals from the counter 20 that the designated coins in the predetermined number N or n have passed through the counter 20 and sent to the stacker 30, the CPU 80 outputs signals to the support moving means 92 to move the support member 42 which has been retracted sideway below the rollers 41, 41, 41, to a position immediately underneath the shutter 33 through the three rollers 41, 41, 41. The support means 42 is set to move with a timing so that it comes to said position immediately below the shutter 33 when the pair of drums 32, 32 rotates once to place the stacked coins on the shutter 33. When the CPU 80 detects that the drums 32, 32 have rotated once based on the detection signals from the rotary encoder 86 for detecting the rotation of the drums, it outputs the signal for opening the shutter to the shutter drive means 93 to thereby open the shutter 33 and transfer the stacked coins to the surface of the support member 42.

When the supporting member 42 receives the stacked coins, it starts moving downward, and in synchronization thereto, rollers 41, 41, 41 are driven by the drive means 94 to rotate and approach to each other. At the same time, the roller 44 pulls out the paper from the paper roll 43 to supply the paper between the rollers 41, 41, 41, and the stacked coins supported by the support means 42. The stacked coins are thus held by the rollers 41, 41, 41 via the paper. When a predetermined length of paper is fed by the roller 44, the roller 44 is suspended, and the paper is pressed on the cutter 45 with the tension produced on the paper by the rotation of the rollers 41, 41, 41 and cut. Thus, paper of the predetermined length is placed around the stacked coins. Then, the paper is crimped at the top and bottom thereof to complete a roll of wrapped coins.

When the number of coins to be wrapped in one roll is designated by an operator, the crimping claws 46, 46 are automatically moved to a level corresponding to the height of a stack of the coins of the designated number by a crimping claw moving means (not shown) to enable crimping of the paper wrapped around stacked coins at the top and bottom thereof. However, when the number of coins to be wrapped in one roll differs from the standard number N stored in the ROM 81, as the width of the paper must correspond to with the height of the stacked coins of the number n, the paper roll 43 must be replaced with another roll having the width corresponding to the stack height of n pieces of coins.

Although the first gate 70 is normally situated at the second position shown with the solid line in FIG. 3, upon a lapse of predetermined time after the stacked coins are transferred from the shutter 33 to the support means 42, when wrapping operation has advanced to an extent where coins would not drop, the gate 70 is switched to take the first position shown with the broken line in FIG. 3 by the first gate switching means 95. When a roll of stacked coins is received by the second gate 72 via the chute 71, the gate is switched again to the second position. As all those movements of the gate are controlled by the CPU 80, when one roll of stacked coins is obtained, the roll is sent via the chute 71 to the second gate 72 sequentially.

When the second gate 72 receives the roll of stacked and wrapped coins, the second gate drive means 96 rotates the gate 72 clockwise by ca. 90 degrees in FIG. 3 to transfer the received roll onto the guide plate 74 which is inclined in FIG. 3 toward the right lower side. The coin roll placed on the guide plate 74 is further advanced thereon until it is received by the coin lift 75 provided at the terminal of the plate 74. When the CPU 80 detects that the roll has been received by the lift 75, the CPU 80 actuates the coin lift drive means 98 to elevate the lift 75 so that the coin roll is housed in the box 76. When one roll of wrapped coins is housed inside the box 76, the number of rolls, the amount and the number of the coins by denominations housed in the box 76 are stored in a predetermined memory within the RAM 82 and displayed at the display 101.

As described in the foregoing statement, coins of the predetermined number N or n are wrapped in one roll, and roll of coins is housed in the box 76. At the time point when the stacked coins of the predetermined number N or n are held with the three rollers 41, 41, 41, the drive means 93 shuts the shutter 33, rotates reversely the stopper 21 which has prevented the subsequent coins from being carried further, and resumes the rotation of the disc 3 and the running of the belts 6 and 17.

In this manner, coins of the preset number N or n are successively wrapped, the second roll and subsequent rolls thereafter are sequentially housed in the box 76. With each cycle, the memory in the RAM 82 is renewed and the display at the display 101 is renewed.

In case the number of the designated coins which have been deposited in the machine is a multiple of the predetermined number N or n by an integer, when the last roll has been housed in the box 76, there is no more coin left unwrapped in the machine and the operation is completed.

However, when the number of designated coins deposited in the machine is not a multiple of the preset number N or n by an integer, there remains designated coins of a number less than N or n inside the machine. Whether or not such fractional coins in a number less than N or n are left within the machine can be determined by the counting signals detected by the first and second sensors 8, 9 and the counter 20. When the CPU 80 judges that fractional coins are left, it actuates the first gate drive means 95 to shift the position of the first gate 70 to the first position without actuating the supporting member moving means 92 and the means 94. When the pair of drums 32, 32 have rotated once, the CPU 80 opens the shutter 33 by driving the means 93 so that the fractional coins stacked on the shutter 33 may be sent to the second gate 72 via the chute 71. Then the CPU 80 drives the second gate drive means 96 to rotate the second gate 72 counterclockwise by ca. 90 degrees in FIG. 3 so that the fractional coins that are sent to the second gate 72 may be collected in the box 73. When the fractional coins are collected in the box 73, the number and the amounts of the coins by denominations are stored in a predetermined memory in the RAM 82, and are displayed at the display 101.

The wrapping operation of the designated coins are normally completed by the above mentioned procedure. However, when the CPU 80 judges based on the counting signals inputted from the first and second sensors 8, 9 and the counting signals inputted from the counter 20 that not all of the coins supplied from the disc 3 are sent to the stacker and that jamming has occurred either in the first or the second passage 4 or 15 because the number of the designated coins detected by the counter 20 is less than their number detected by the first and second sensors 8, 9, the CPU 80 drives the first means 90 to rotate the disc 3 reversely and to run the belts 6 and 17 reversely, and then to rotate the disc normally and to run the belts normally. When the counter 20 does not detect the expected number of the coins despite those steps or when "jamming inside the passage" is judged to have occurred by the CPU 80, or when the number of pulses outputted from the control system to the stack drum rotating means 91 is larger than the number of pulses necessary to stack the coins of N or n pieces on the stacker 30 by a number larger than a preset number, the CPU 80 judges that at least a part of the coins are not being supported desirably by the spiral projections 31, 31 of the drums 32, 32 for example, standing on their sides in the stacker 30, or when "the irregular stacking" is judged to have taken place, the CPU 80 maintains the first gate 70 at the second position by the means 95 without actuating the means 92 and 94, and actuates the means 93 when the pair drums 32, 32 have rotated once, to open the shutter 33 so that the stacked coins on the surface of the shutter 33 may be collected in the lower hopper 54 via the chute 77. When at least a part of the stacked coins which have been stacked by the stacker 30 drop from the supporting member 42 during their transfer from the shutter 33 to the support member 42 instead of being properly received thereby or when "irregular transportation" takes place, the dropped coins are guided by the first gate which is at the second position to the lower hopper 54 via the chute 77 and collected therein. Such "irregular transportation" can be detected by the CPU 80 from the coin collision signals inputted from the microphone 87.

When "jamming inside the passage" , "irregular stacking" or "irregular transportation" occurs, as the relevant coins are counted by the first and second sensors 8 and 9 as the coins which have been deposited in the coin wrapping machine, and are included in the amount and the number of received coins stored in the predetermined memory in the RAM 82, the CPU 80, when it detects such irregularity, calculates the amount and the number of designated coins which are collected in the lower hopper 54 via the chute 77 based on the counting signals inputted from the first and second sensors 8 and 9 and the counter 20 and subtracts them from the amount and the number of the designated coins stored in the memory of the RAM 82. The CPU 80 further drives the means 99 to transfer the designated coin from the lower hopper 54 to the upper hopper 2 via the first and second conveyor belts 57 and 58 and then to the coin wrapping section 40 via the disc 3, the first and second coin sorting passages 4 and 15 and the stacker 30 to be wrapped and housed in the form of a roll in the box 76. When the "jamming inside the passage" occurs, the jamming should be solved manually by opening the top of the casing 1. The display 11 indicates that "the jamming has occurred in the passage."

In case the operator had initially instructed by the manipulation of the key the wrapping of the designated coins alone, the wrapping operation is completed when the coins designated to be wrapped first has been completed. The coins of the denominations other than the designated coins which are collected inside the box 51 are recovered by opening a door (not shown) formed on the casing 1 and sliding the box 51 out along the sliding rails 56 from the machine.

On the other hand, in case the operator had instructed in advance by a key that coins of the other denominations than the designated one be wrapped in sequence, such coins are wrapped in the steps similar to the above based on the data stored in either ROM 81 or RAM 82. However, if "jamming inside the passage", "irregular stacking", or "irregular transportation" occurs in respect of the coins of the second and subsequent denominations, and even if a part of the coins to be wrapped collected the lower hopper 54 has been returned to the upper hopper 2, subtraction is unnecessary since the amount and number of the coins of the denominations other than the designated one have already been counted and stored in the predetermined memory in the RAM 82. The CPU 80 therefore does not conduct subtraction processing under such irregularities.

When the operator selects with a mode key the wrapping mode, the sensors 8 and 9 do not detect the denomination nor count the amount or the number of received coins, but only detect the genuineness of the deposited coins. The number of designated coins is counted by the counter 20, and the amount and the number of designated coins are stored in the memory of the RAM 82 and displayed at the display 101.

When the wrapping mode is selected, it is possible to designate and wrap coins of an arbitrary denomination. It is also possible to wrap the coins in the order of diameter either from the largest or the smallest or of the volume of currency. However, it is not possible to wrap the coins in the order from the largest number of pieces as the deposited coins are not counted by the denominations. Other steps are similar to the case where the mode of wrapping/counting is selected.

When the operator selects the counting mode with a mode key, the first space setting means 88*a* sets the space between the guide surface 13*a* of the guide member 13 and the inner guide rail 7 to be smaller than the smallest diameter of the coins to be deposited in the machine. The deposited coins are detected of genuineness and the denomination thereof by the first and second sensors 8 and 9, and counted of the amount by denominations and the number. Those data are stored in the memory in the RAM 82 and displayed at the display 101. As the space between the guide rail 7 and the guide surface 13*a* of the guide member 13 is set to be smaller than the smallest diameter of the coins received by the machine, all the deposited coins come to ride over the sloped surface 13*b* of the member 13 and are collected through the port 14 via the chute 50 in the box 51.

In case the result of counting of the coins actually received in the machine and the amount of the coins which the operator predicted do not agree, the door (not shown) on the casing 1 is opened, and the box 51 is slid along the rail 56 out of the machine so as to recover the coins in the box 51. In case the order of wrapping according to denominations is determined based on the result of counting and wrapping is conducted thereafter, the means 98 is actuated by manipulating the mode key and wrapping key at the section 100 to open the gate 55 of the box 51 so that the coins in the box may be transferred to the lower hopper 54, and then the means 99 is actuated to transfer the coins to the upper hopper 2 to thereby enable the coins to be wrapped in the order of desired denominations.

As descried in detail in the foregoing statement, according to this embodiment, the coins having a larger diameter than the designated coins are collected through the port 14 and those having a smaller diameter than the designated coins are collected through the port 19 into the box 51 respectively, whereby wrapping of coins becomes possible by arbitrarily designating a desired denomination and distinguishing them from coins of other denominations. Coins of the denomination second in the order of wrapping may be selected arbitrarily by transferring the coins of denominations other than the designated one from the collecting box 51 to the lower hopper 54, setting the space between the inner guide rail 7 and the surface 13*a* of the guide member 13 to be such that only the coins of the denomination second in the order may be transferred to the stacker 30 and sending the coins into the upper hopper 2. Thus, coins of different denominations can be sorted out and wrapped in the order of preferred denominations. As the machine is equipped with the first and second sensors 8 and 9 and the counter 20, the amount and the number of received coins can simultaneously be counted.

As the first gate 70 is provided downstream of the wrapper 40 in this embodiment, if the jamming inside the passage, irregular stacking or irregular transportation occurs, the coins which have been stacked may be recovered in the lower hopper 54. Simply by transferring them to the upper hopper 2, automatic wrapping/-processing becomes possible, remarkably enhancing the process efficiency.

According to this embodiment, as there are provided the first and second conveyor belts 57 and 58 for transferring the coins from the lower hopper 54 to the upper hopper 58, even if the quantity of the coins to be processed is quite large, it is not necessary to lift such a large quantity of coins to feed them to the upper hopper 2. Instead, by simply feeding them to the lower hopper 54, they will automatically be wrapped and processed, and the operation efficiency is enhanced remarkably.

As described above in detail referring to the accompanying drawings based on an embodiment, this invention can provide a coin wrapping machine which can count and discriminate coins in separate denomination groups by designating an arbitrary denomination with a single piece of equipment.

The present invention has thus been shown and described with reference to the specific embodiment. However, it should be noted that the present invention is in no way limited to the details of the described arrangements but changes and modifications may be made without departing from the scope of the appended claims.

For instance, although in the above embodiment, the first and second sensors 8 and 9 are used to detect the genuineness and the denomination of the coins, a single sensor of high precision may well be used to detect both of them.

Although in the above embodiment, all the deposited coins are collected in the box 51 by setting the space between the inner guide rail 7 and the surface 13*a* of the member 13 to be smaller than the smallest diameter of the coins which are to be put in the machine, it is possible to achieve the same effect by so setting the above space as to allow the coins of the designated denomination or the coins of the largest diameter to be sent to the second passage 15 and by setting the space between the pair of the guide 16, 16 to be such that the port 19 becomes larger than the largest diameter of the coins by the second space setting means to thereby collect all the coins either through the ports 14 and 19 or the port 19 alone.

Although in the above embodiment, the second gate 72 is provided below the chute 71 to have an L-letter shape cross section, the second gate 72 may be formed with a flat plate, and normally so positioned as to guide the wrapped coins into the guide plate 74. The gate 72 may be rotated to allow communication between the chute 71 and the box 73 only when fractional coins are judged necessary to be collected based on the counting signals from the counter 20.

In the above description of the embodiment, although the timing is set in a manner that the stacked coins of the designated denomination are carried upon the shutter 33 when the pair of stack drums 32, 32 are rotated once, a separate means may be provided to detect whether or not the designated coins which have been stacked by the pair of the stack drums 32, 32 are placed on the shutter 33 irrespective of the number of revolution of the drums 32, 32, and the shutter may be controlled with the detection signal thereof.

Although in the above embodiment, the first driving means 90 is used to actuate the rotation of the disc 3, the running of the conveyor belts 6 and 17 and the rotation of the stoppers 10 and 21, those operations may be effected by separate driving means. Alternatively, one or more of the means may be driven exclusively by a means and others may be driven by other one or more means. As to the driving means for the stack drums 32, 32 and the shutter 33, instead of providing one each means as described in the foregoing statement, any two or more of the means may be driven by one driving means at an appropriate timing.

Although a coin rejecting gate 12 is provided within the first coin sorting passage 4 to remove counterfeit or uncurrent coins from the passage and transfer them to the box 53, it may not necessarily be equipped. Instead, a coin rejecting gate may be provided in the chute 50, and the space between the inner guide rail 7 and the surface 13*a* of the guide member 13 may be set smaller than the smallest diameter of the coins or the space between the pair of the guide rails 16 is set to be larger than the largest diameter of the coins by the second space setting means so that all the coins are guided into the chute 50. The CPU 80 controls the gate to close/open at a predetermined timing based on the genuineness detection signals from the first and second sensors 8 and 9, whereby counterfeit or uncurrent coins are rejected via the chute 52 into the box 53, and all the genuine coins are collected in the box 51 and guided to the upper hopper 2 via the lower hopper 54 for wrapping processing designated by the mode key.

Moreover, a designated coin collecting gate may be provided in the second coin sorting passage 15 downstream of the counter 20 and the stopper 21 in an openable fashion so that the coins of the denominations other than the designated one are collected through the ports 14 and 19 into the box 51 while all the designated coins are collected through the gate into the designated coin collecting box. This arrangement enables counting of the received coins in terms of the monetary amount and the number broken down by denominations as well as discrimination of the designated coins from all the other coins. In such a case, the first and second sensors 8 and 9 are adapted to detect only the genuineness of the coins, and count the amount and the number of only the designated coins.

What we claim is:

1. A coin wrapping machine comprising upper hopper means for depositing of coins, a first coin sorting passage for carrying the coins that have been deposited through said upper hopper means, sensor means provided on said first coin sorting passage for detecting the genuineness and the denomination of the coins as well as for counting the coins in separate denomination groups, coin rejecting gate means for passage of coins rejected by said sensor means on said first coin sorting passage, a guide member connected downstream of said first coin sorting passage, said guide member being equipped with a larger diameter coin collecting means for collecting coins of a diameter larger than a diameter of the coins to be wrapped, a second coin sorting passage connected downstream of said guide member for carrying the coins in a direction different from that of said first coin sorting passage and said second coin sorting passage being equipped with a smaller diameter coin collecting means for collecting coins of a diameter smaller than the diameter of said coins to be wrapped, counter means provided on said second coin sorting passage downstream of said smaller diameter coin collecting means for counting the number of coins sent through said second coin sorting passage, coin stacking means provided downstream of said second coin sorting passage and said coin stacking means being equipped with a pair of stack drums for stacking the coins from said second coin sorting passage, coin wrapping means for receiving stacked coins from said coin stacking means and for wrapping the stacked coins in a predetermined number in the form of a roll, wrapped coin housing means for housing the rolls of wrapped coins wrapped by said coin wrapping means, collecting box means for communicating with said larger diameter coin collecting means and said smaller diameter coin collecting means, an open/close gate located at a bottom of said collecting box means, lower hopper means located below said collecting box means and said coin wrapping means for communicating with said collecting box means by opening said open/close gate and for communicating with said coin wrapping means, conveyor means for conveying the coins in said lower hopper means to said upper hopper means, fractional coin collecting means provided below said coin wrapping means for collecting coins of a number less than said predetermined number, first gate means provided between said coin wrapping means and said fractional coin collecting means, second gate means provided between said first gate means and said fractional coin collecting means, coin feed detection means for detecting coins being fed to said coin stacking means, rotation detection means for detecting the number of revolutions of said pair of stack drums; and control means for receiving detecting and counting signals from said sensor means, counting signals from said counter means, coin feed signals from said coin feed detection means and rotation detection signals from said rotation detection means to count at least one of the monetary amount and the number of received coins in separate denomination groups, maintains said first gate means at a position not communicable with said coin wrapping means and said second gate means for a predetermined time after said coin wrapping means has received stacked coins from said coin stacking means, and when the control means judges based input signals that coins are jammed in one of said first coin sorting passage and said second coin sorting passage as the number of coins of the denomination to be wrapped which is detected by said sensor means exceeds the number of the coins of said denomination which is detected by said counter means, or when the control means judges the number of revolutions of said pair of stack drums detected by said rotation detection means exceeds, by a margin larger than a predetermined number, the number of revolutions corresponding to the number of coins of said denomination fed to said coin stacking means which is detected by said coin feed detection means, then the control means does not actuate said coin wrapping means but maintains said first gate means at the position not communicable with said coin wrapping means and said second gate means so as to guide the coins stacked by said coin stacking means to said lower hopper means.

2. The coin wrapping machine as claimed in claim 1, wherein said first coin sorting passage is provided with a pair of guide rail means, said guide member is connected to a terminal end of one of said pair of guide rail means and is provided with a guide surface for guiding the coins of the diameter smaller than said coins to be wrapped, and with a sloped surface gradually elevated toward an advancing direction of said first coin passage, said larger diameter coin collecting means comprises an opening positioned at the terminal end of said sloped surface, and space setting means is provided setting the space between the guide surface of said guide member and the other guide rail means opposed thereto.

3. The coin wrapping machine as claimed in claim 1, wherein said second coin sorting passage is equipped with a pair of guide rail means adjustable in space therebetween, said smaller diameter coin collecting means comprises an opening formed between said pair of guide rail means, and space setting means is further provided for setting the space between said pair of guide rail means.

4. The coin wrapping machine as claimed in claim 2, wherein said second coin sorting passage is equipped with a pair of guide rail means adjustable in space therebetween, said smaller diameter coin collecting means comprises an opening formed between said pair of guide rail means, and a second space setting means is further provided for setting the space between said pair of guide rail means.

5. The coin wrapping machine as claimed in claim 1, wherein a vibration detection means is further provided for detecting the vibration on said first gate means and outputting vibration detection signals to said control means, and when said control means judges that the number of coins to be wrapped detected by said sensor means exceeds the number of coins of said denomination to be wrapped detected by said counter means, or that coins are jammed in one of said first coin sorting passage and the second coin sorting passage, or when the control means judges that the number of revolutions of said pair of stack drums detected by said rotation detection means exceeds by a predetermined number the number of revolutions corresponding to the number of coins of said denomination fed to said coin wrapping means detected by said coin feed detection means, or when the control means maintains said first gate means at the position not communicable with said coin wrapping means and said second gate means instead of actuating said coin wrapping means to guide the coins stacked by said coin stacking means to said lower hopper means, or when the control means judges that said first gate means vibrates more than a predetermined level based on the vibration detection signals inputted from said vibration detection means, then the control means subtracts at least one of the amount and the number of coins of said denomination to be wrapped fed to said coin stacking means, based on the counting signals inputted from said counting means, from at least one of the amount and the number of received coins counted in separate denomination groups based on the detection signals inputted from said sensor means.

6. The coin wrapping machine as claimed in claim 2, wherein a vibration detection means is further provided for detecting the vibration on said first gate means and outputting vibration detection signals to said control means, and when said control means judges that the number of coins to be wrapped detected by said sensor means exceeds the number of coins of said denomination to be wrapped detected by said counter means, or that coins are jammed in one of said first coin sorting passage and the second coin sorting passage, or when the control means judges that the number of revolutions of said pair of stack drums detected by said rotation detection means exceeds, by a predetermined number, the number of revolutions corresponding to the number of coins of said denomination fed to said coin wrapping means detected by said coin feed detection means, or when the control means maintains said first gate means at the position not communicable with said coin wrapping means and said second gate means instead of actuating said coin wrapping means to guide the coins stacked by said coin stacking means to said lower hopper means, or when the control means judges that said first gate means vibrates more than a predetermined level based on the vibration detection signals inputted from said vibration detection means, then the control means subtracts at least one of the amount and the number of coins of said denomination to be wrapped fed to said coin stacking means, based on the counting signals inputted from said counting means, from at least one of the amount and the number of received coins counted in separate denomination groups based on the detection signals inputted from said sensor means.

7. The coin wrapping machine as claimed in claim 3, wherein vibration detection means is further provided for detecting the vibration on said first gate means and outputting vibration detection signals to said control means, and when said control means judges that the number of coins to be wrapped detected by said sensor means exceeds the number of coins of said denomination to be wrapped detected by said counter means, or that coins are jammed in one of said first coin sorting passage and the second coin sorting passage, or when the control means judges that the number of revolutions of said pair of stack drums detected by said rotation detection means exceeds, by a predetermined number, the number of revolutions corresponding to the number of coins of said denomination fed to said coin wrapping means detected by said coin feed detection means, or when the control means maintains said first gate means at the position not communicable with said coin wrapping means and said second gate means instead of actuating said coin wrapping means to guide the coins stacked by said coin stacking means to said lower hopper means, or when the control means judges that said first gate means vibrates more than a predetermined level based on the vibration detection signals inputted from said vibration detection means, then the control means subtracts at least one of the amount and the number of coins of said denomination to be wrapped which have been fed to said coin stacking means, based on the counting signals inputted from said counting means, from at least one of the amount and the number of received coins counted in separate denomination groups based on the detection signals inputted from said sensor means.

8. The coin wrapping machine as claimed in claim 4, wherein vibration detection means is further provided for detecting the vibration on said first gate means and outputting vibration detection signals to said control means, and when said control means judges that the number of coins to be wrapped detected by said sensor means exceeds the number of coins of said denomination to be wrapped detected by said counter means, or that coins are jammed in one of said first coin sorting passage and the second coin sorting passage, or when the control means judges that the number of revolutions of said pair of stack drums detected by said rotation detection means exceeds, by a predetermined number, the number of revolutions corresponding to the number of coins of said denomination fed to said coin wrapping means detected by said coin feed detection means, or when the control means maintains said first gate means at the position not communicable with said coin wrapping means and said second gate means instead of actuating said coin wrapping means to guide the coins stacked by said coin stacking means to said lower hopper means, or when the control means judges that said first gate means vibrates more than a predetermined level based on the vibration detection signals inputted from said vibration detection means, then the control means subtracts at least one of the amount and the number of coins of said denomination to be wrapped which have been fed to said coin stacking means, based on the counting signals inputted from said counting means, from at least one of the amount and the number of received coins counted in separate denomination groups based on the detection signals inputted from said sensor means.

9. The coin wrapping machine as claimed in claim 4, wherein manipulation means is further provided for inputting to said control means the order of setting the spaces between said guide surface of the guide member and the other guide rail of said pair of guide rails and between said pair of guide rails by said first space setting means and said second space setting means.

10. The coin wrapping machine as claimed in claim 8, wherein manipulation means is further provided for inputting to said control means the order of setting the spaces between said guide surface of the guide member and the other guide rail of said pair of guide rails and between said pair of guide rails by said first space setting means and said second space setting means.

* * * * *